US008549761B2

(12) United States Patent
Araki et al.

(10) Patent No.: US 8,549,761 B2
(45) Date of Patent: Oct. 8, 2013

(54) CHAIN SAW

(75) Inventors: Minoru Araki, Tokyo (JP); Toshihisa Nemoto, Tokyo (JP); Katsutoshi Inagaki, Tokyo (JP); Eiji Matsuoka, Tokyo (JP)

(73) Assignee: Maruyama Mfg. Co. Inc., Tokyo (JP)

( * ) Notice: Subject to any disclaimer, the term of this patent is extended or adjusted under 35 U.S.C. 154(b) by 288 days.

(21) Appl. No.: 13/015,205

(22) Filed: Jan. 27, 2011

(65) Prior Publication Data

US 2011/0179653 A1 Jul. 28, 2011

(30) Foreign Application Priority Data

Jan. 28, 2010 (JP) ..... 2010-016777

(51) Int. Cl.
*B27B 17/14* (2006.01)
*B23D 57/02* (2006.01)

(52) U.S. Cl.
USPC ..... 30/386; 30/382; 83/814

(58) Field of Classification Search
USPC ..... 30/381–386; 83/809–820; 188/166, 188/77 R
See application file for complete search history.

(56) References Cited

U.S. PATENT DOCUMENTS

| | | | | |
|---|---|---|---|---|
| 3,457,970 | A * | 7/1969 | Locati | 30/381 |
| 3,636,995 | A | 1/1972 | Newman | |
| 4,057,900 | A * | 11/1977 | Nagy et al. | 30/382 |
| 6,944,958 | B1 * | 9/2005 | King | 30/387 |
| 7,350,301 | B2 * | 4/2008 | Chung Lee | 30/386 |
| 7,434,502 | B2 * | 10/2008 | Keeton et al. | 83/816 |
| 7,600,323 | B2 * | 10/2009 | Sugishita | 30/386 |
| 7,743,513 | B1 * | 6/2010 | Fisher et al. | 30/386 |
| 2006/0016081 | A1 * | 1/2006 | Keeton et al. | 30/386 |
| 2007/0044629 | A1 * | 3/2007 | Chung Lee | 83/788 |
| 2010/0146801 | A1 * | 6/2010 | Pellenc | 30/386 |
| 2010/0293797 | A1 * | 11/2010 | Fisher et al. | 30/386 |
| 2011/0314682 | A1 * | 12/2011 | Maag et al. | 30/386 |

FOREIGN PATENT DOCUMENTS

| | | | |
|---|---|---|---|
| EP | 0 878 279 | A1 | 11/1998 |
| EP | 1 619 004 | A1 | 1/2006 |
| EP | 1 637 299 | A1 | 3/2006 |
| EP | 1 764 197 | A2 | 3/2007 |
| JP | 47-001949 | Y1 | 1/1972 |
| JP | 60-39201 | | 11/1985 |
| JP | 3128689 | A | 5/1991 |
| JP | 2006015606 | A | 1/2006 |
| JP | 2006027261 | A | 2/2006 |
| JP | 2011025470 | A | 2/2011 |
| JP | 2011-148183 | * | 8/2011 |
| WO | 2004103657 | A1 | 12/2004 |

OTHER PUBLICATIONS

European Search Report issued in European Application No. 11152293.4-1262 dated May 6, 2011, 5 pages.
Japanese Office Action for Japanese Application No. 2010-016777, mailed on Dec. 6, 2011, (2 pages).

(Continued)

*Primary Examiner* — Laura M Lee
(74) *Attorney, Agent, or Firm* — Osha Liang LLP

(57) ABSTRACT

In a chain saw, the tension of a saw chain attached around the outer edge of a guiding bar can be adjusted appropriately by adjusting the force transmitted to a connecting unit during operation of a hand guard. Thus, the saw chain 6 can be easily strained at great tension without use of a strong coil spring.

5 Claims, 13 Drawing Sheets

(56) References Cited

OTHER PUBLICATIONS

Patent Abstracts of Japan, Publication No. 2011-025470, publication date Oct. 2, 2011, 1 page.
Patent Abstracts of Japan, Publication No. 2006-015606, publication date Jan. 19, 2006, 1 page.
Patent Abstracts of Japan, Publication No. 2006-027261, publication date Feb. 2, 2006, 1 page.

* cited by examiner

CHAIN SAW

BACKGROUND OF THE INVENTION

1. Field of the Invention

The present invention relates to a chain saw.

2. Related Background Art

As described in Patent Literature 1, a known straining mechanism of a saw chain includes a main body having a rotating unit transmitting a driving force, a guiding bar attached to the main body and extending forward from the main body, and an endless saw chain attached around the outer edges of the rotating unit and guiding bar, and a coil spring that biases a tension member disposed in a hole in the guiding bar, in the direction (forward) of the extending guiding bar.

In this mechanism, the guiding bar is pushed in the extending direction by the biasing force of the coil spring to apply predetermined tension to the saw chain attached to the guiding bar. The pushed-out guiding bar is fixed to the main body by being tightened with a bolt (Patent Literature 1: Japanese Examined Utility Model Application Publication No. 60-39201).

SUMMARY OF THE INVENTION

Problems to be Solved by the Invention

Since the guiding bar in the mechanism is pushed out only by the biasing force of the coil spring, a strong coil spring must be used in order to strain the saw chain at sufficient tension. Consequently, the mechanism cannot be readily controlled.

Accordingly, the present invention provides a chain saw an operator can easily strain a saw chain.

Means of Solving the Problems

A chain saw according to the present invention includes a main body having a rotating unit transmitting a driving force; a guiding bar attached to the main body and extending from the front of the main body; an endless saw chain attached around the outer edges of the rotating unit and guiding bar; a guiding unit guiding the guiding bar in an extending direction of the guiding bar; a hole provided in the guiding bar and extending in the thickness direction of the guiding bar; a locking protrusion disposed in the hole; and a connecting unit connecting the locking protrusion and an operating lever operated by an operator, wherein the guiding bar and the locking protrusion disposed in the hole of the guiding bar move in the extending direction being a straining direction of the saw chain, in response to an operation of the operating lever.

In the chain saw according to the present invention, the locking protrusion disposed in the hole of the guiding bar is connected to the operating lever by the connecting unit. The locking protrusion moves in the extending direction in response to the operation of the operating lever. In response to the movement of the locking protrusion, the guiding bar is guided by the guiding unit to move in the extending direction being the straining direction of the saw chain. The tension of the saw chain attached along the outer edges of the guiding bar can be adjusted appropriately by adjusting the force transmitted to the connecting unit during operation of the operating lever. Thus, the saw chain can be easily strained at great tension without use of a strong coil spring.

In the case where the connecting unit includes the spring connected to the operating lever, the force transmitted to the connecting unit can be buffered by the elasticity of the spring. As a result, the tension of the saw chain can be maintained substantially constant.

In the case where the operating lever is a hand guard protecting the operator's hand, the hand guard is also used to adjust tension. As a result, a separate lever for tension adjustment of the saw chain is not required.

Preferably, the chain saw further includes a braking mechanism stopping the rotation of the rotating unit, wherein, when the operating lever turns around a pivotal support within a first range, the operating lever comes into contact with a pivotal lever of the braking mechanism turning around a shaft residing at a position different from the pivotal support, to operate the braking mechanism, and wherein, when the operating lever turns around the pivotal support within a turnable range differing from the turnable range, the operating lever is configured to be detached from the pivotal lever at a position due to the difference in the positions of the pivotal support and the shaft and to be connected to the connecting unit.

With such a configuration, the braking mechanism can be operated in the first range without interference. In the second range, the saw chain can be strained without interference through movement of the guiding bar in response to the operation of the operating lever.

In the case where a first end of the connecting unit has a connecting member including a U-shaped segment and the operating lever includes a pin freely fit into the U-shaped segment, the pin can be unfixed in the U-shaped segment during a normally used state other than tension adjustment of the saw chain. As a result, connection by the connecting unit is not maintained, and cutting by the chain saw can be performed without interference.

In the case where the chain saw further includes a chain case attached to the main body to cover a base of the guiding bar and the locking protrusion, the operating lever, and the connecting unit are integrated in the chain case, these components associated with tension adjustment of the saw chain can be readily assembled.

Advantage Effect of the Invention

With the chain saw according to the present invention, the saw chain can be strained through an easy operation.

DESCRIPTION OF THE PREFERRED EMBODIMENTS

Figure 1:
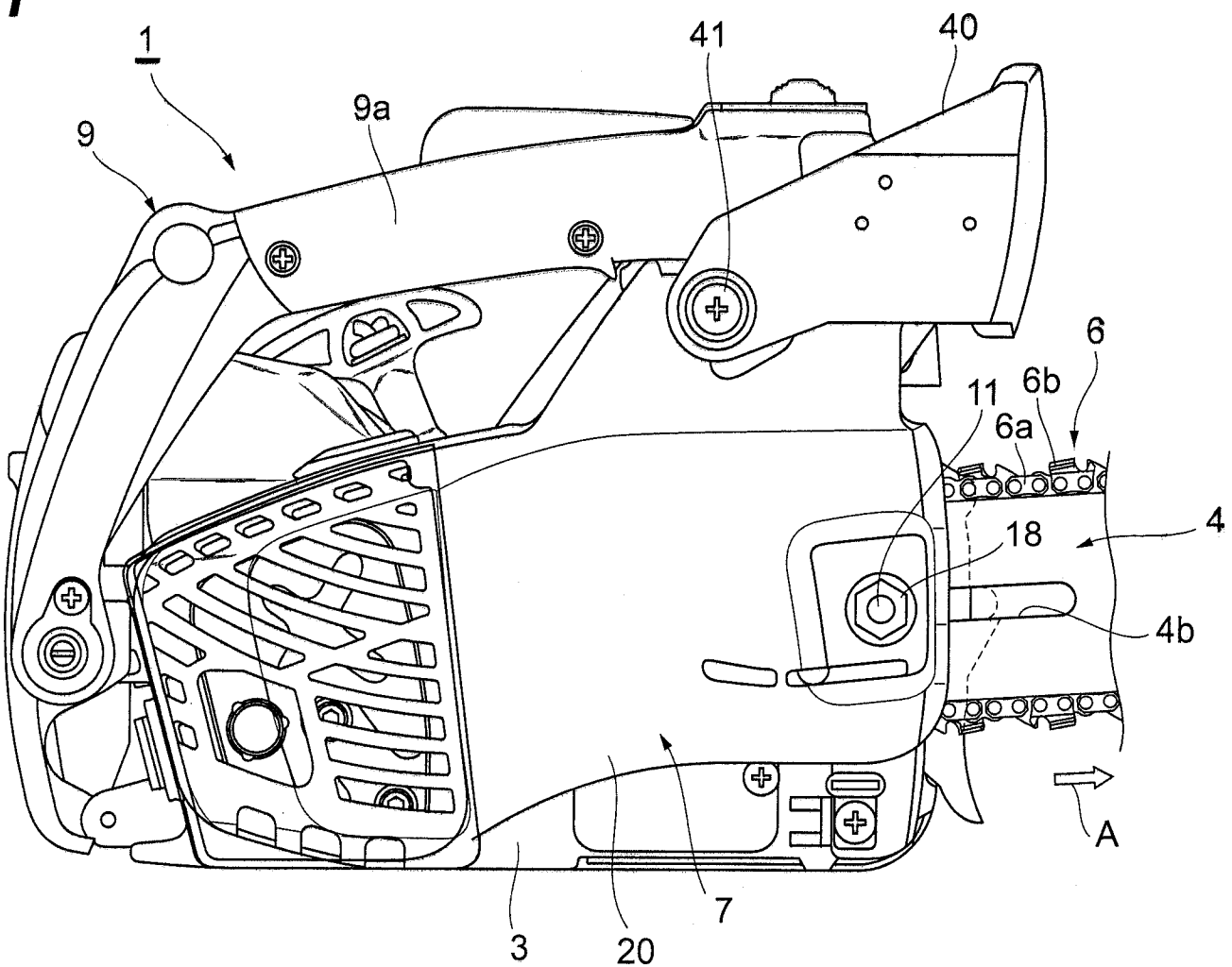
FIG. 1 is a right side view of a chain saw according to a first embodiment of the present invention.

A chain saw according to embodiments of the present invention will be described below with reference to the accompanying drawings. The same components are represented by the same reference numerals without repeated description.

First Embodiment

Figure 2:
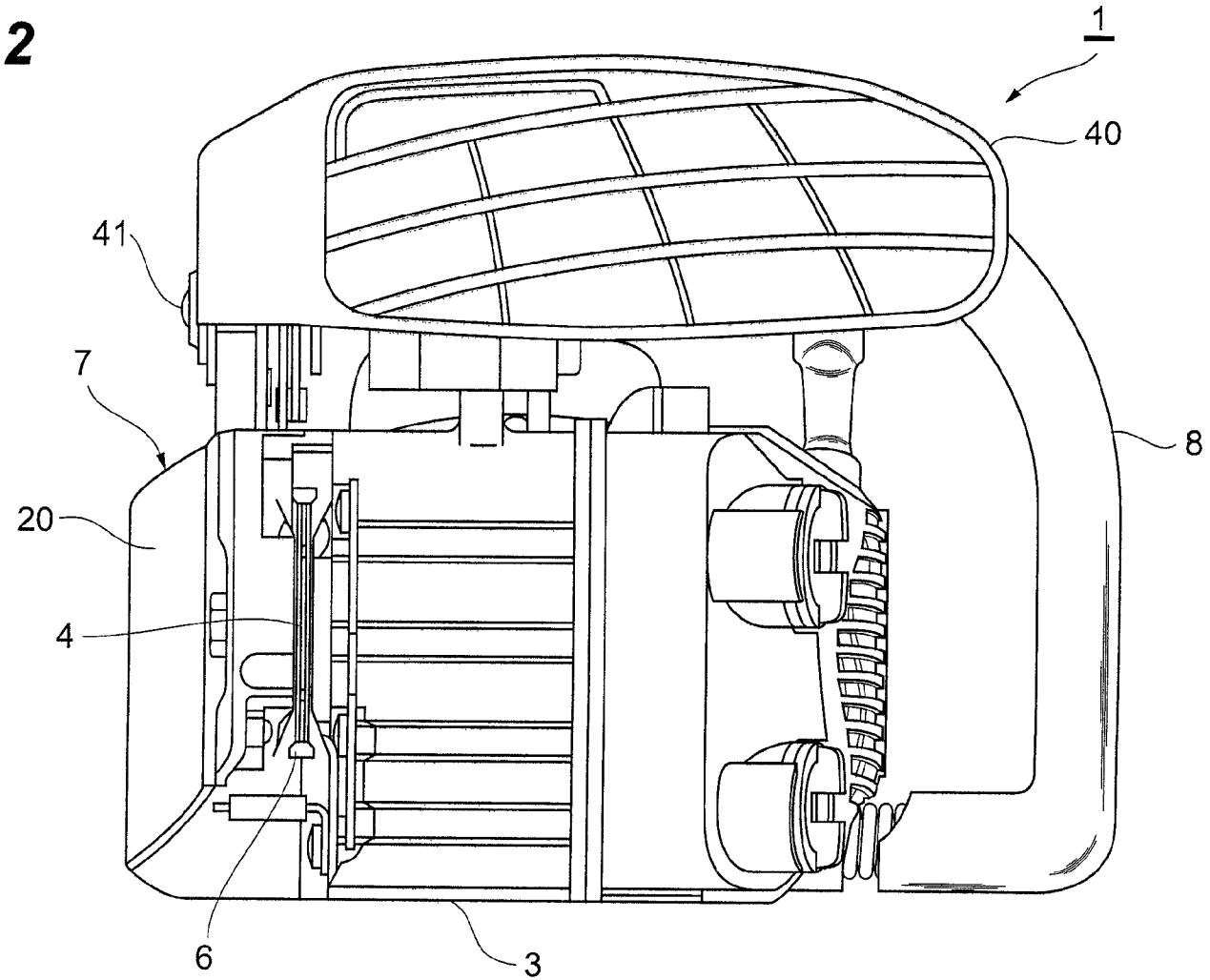
FIG. 2 is a front view of the chain saw in FIG. 1.
Figure 3:
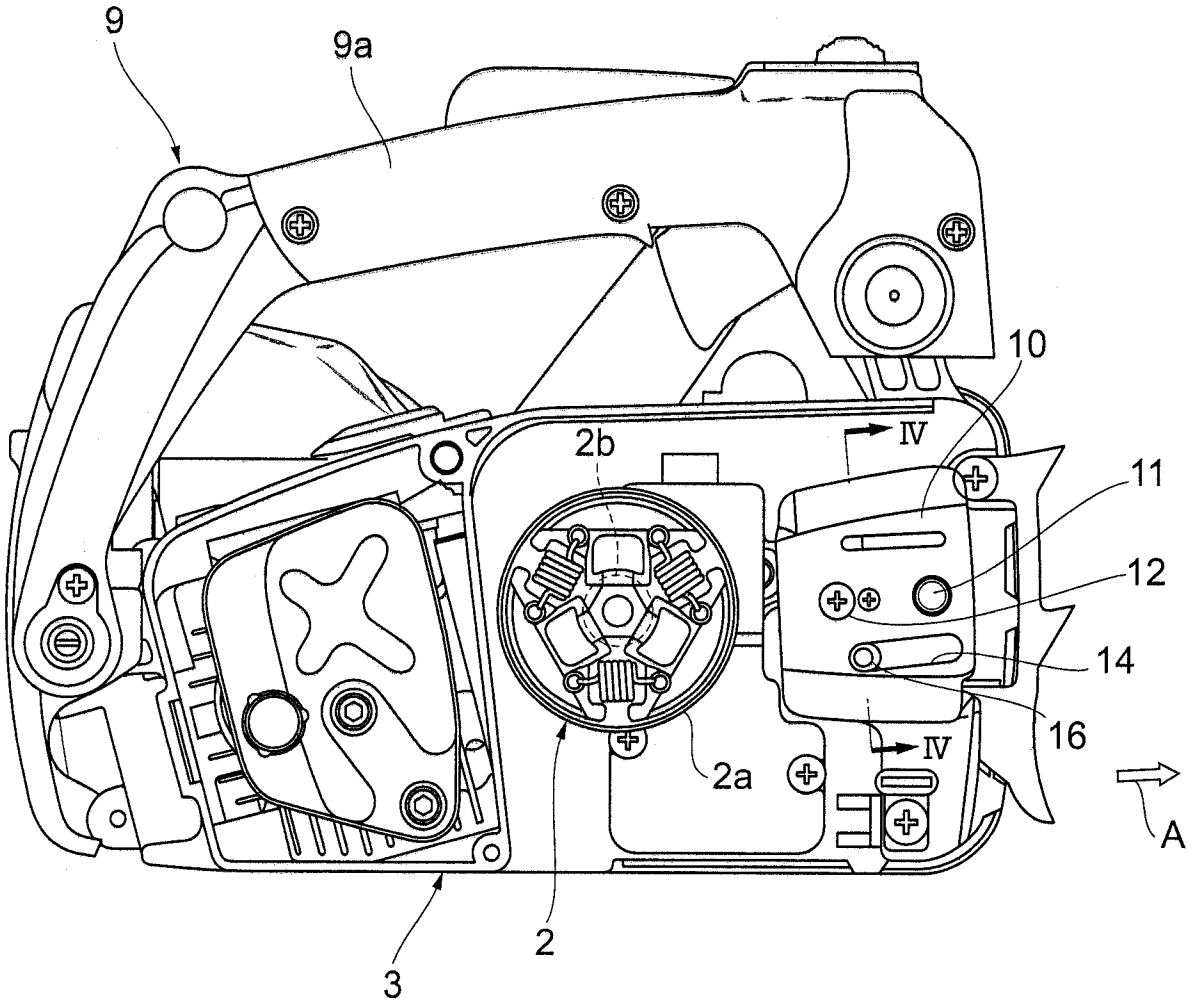
FIG. 3 is a right side view of the main body of the chain saw in FIG. 1.

FIG. 1 is a right side view of a chain saw according to a first embodiment of the present invention. FIG. 2 is a front view of the chain saw in FIG. 1. FIG. 3 is a right side view of the main body of the chain saw in FIG. 1.

The chain saw 1 of this embodiment is operated by an operator to cut an object, such as wood. The chain saw 1 includes the main body 3 having a rotating unit 2 that transmits a driving force, a guiding bar 4 attached to the main body 3 and extending from the front (right side in FIG. 1) of the main body 3, an endless saw chain 6 attached around the outer edges of the rotating unit 2 and guiding bar 4, and a case 7 attached to the main body 3 to cover the rotating unit 2 and the base 4*a* of the guiding bar 4 (see FIG. 5). In this embodiment, unless otherwise specified, the protruding direction of the guiding bar 4 is defined as the forward direction, and the side to which the chain case 7 is attached is defined as the right side.

The rotating unit 2 includes a substantially cylindrical clutch drum 2*a* that is connected to an engine disposed in the main body 3 and that transmits a rotational driving force generated at the engine and a sprocket 2*b* that is provided in the clutch drum 2*a*. The saw chain 6 is an endless chain 6*a* having a saw blade 6*b*. The chain 6*a* extends around the peripheries of the sprocket 2*b* and the guiding bar 4.

In order to operate the chain saw 1, an operator holds a front handle 8 with his/her left hand and holds a grasping part 9*a* of a rear handle 9 with his/her right hand to drive the engine, so that the sprocket 2*b* is rotated by the driving force of the engine and the saw chain 6 moves along a substantially oval orbit around the peripheries of the sprocket 2*b* and the guiding bar 4. Through such operation, the operator can cut an object without pulling the chain saw.

Figure 4:
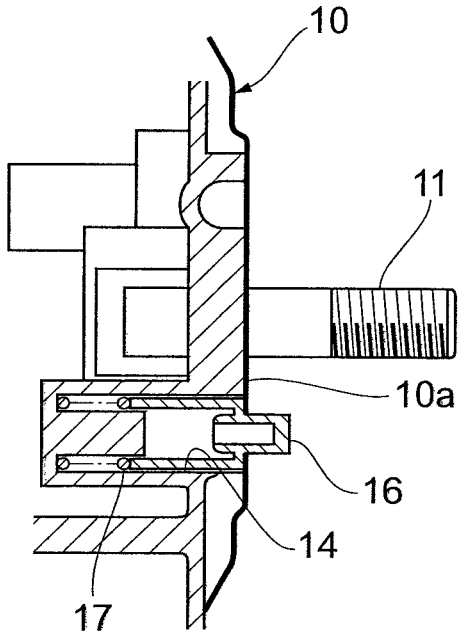
FIG. 4 is a sectional view taken along line IV-IV in FIG. 3.

FIG. 4 is a sectional view taken along line IV-IV in FIG. 3. As illustrated in FIGS. 3 and 4, a guiding plate 10 that attaches the base 4*a* of the guiding bar 4 (see FIG. 5) to the main body 3 is provided on the right side of the main body 3, in the front of the rotating unit 2. A guiding-bar attaching bolt 11 (hereinafter is also referred to as "bolt 11") and a bolt 12, which are aligned in the anteroposterior direction at a distance, protrude perpendicularly from a surface 10*a* of the guiding plate 10 and are disposed parallel to each other. The bolts 11 and 12 are disposed at the central part in the vertical direction of the guiding plate 10.

Furthermore, a groove (groove part) 14 having a predetermined vertical width is formed in the guiding plate 10 along the extending direction A of the guiding bar 4, below the positions of the guiding-bar attaching bolt 11 and the bolt 12.

At the rear edge (left edge in FIG. 3) of the groove 14, a substantially cylindrical cap (protrusion) 16 having a closed tip is disposed perpendicularly to the surface 10*a*. In the groove 14, a compressing spring 17 that urges the cap 16 outward is provided on the base side (bottom side) of the cap 16. In this state, the tip of the cap 16 protrudes outward from the surface 10*a* by a predetermined length.

When the cap 16 receives a pushing force from a boss (locking protrusion) 23 of the chain case 7, which is described below, in the direction from the tip to the base of the cap 16, the cap 16 is pushed into the guiding plate 10 such that the tip retracts further inward than the surface 10*a* (see FIG. 6). In this way, the cap 16 can be pushed into the main body 3.

Figure 5:
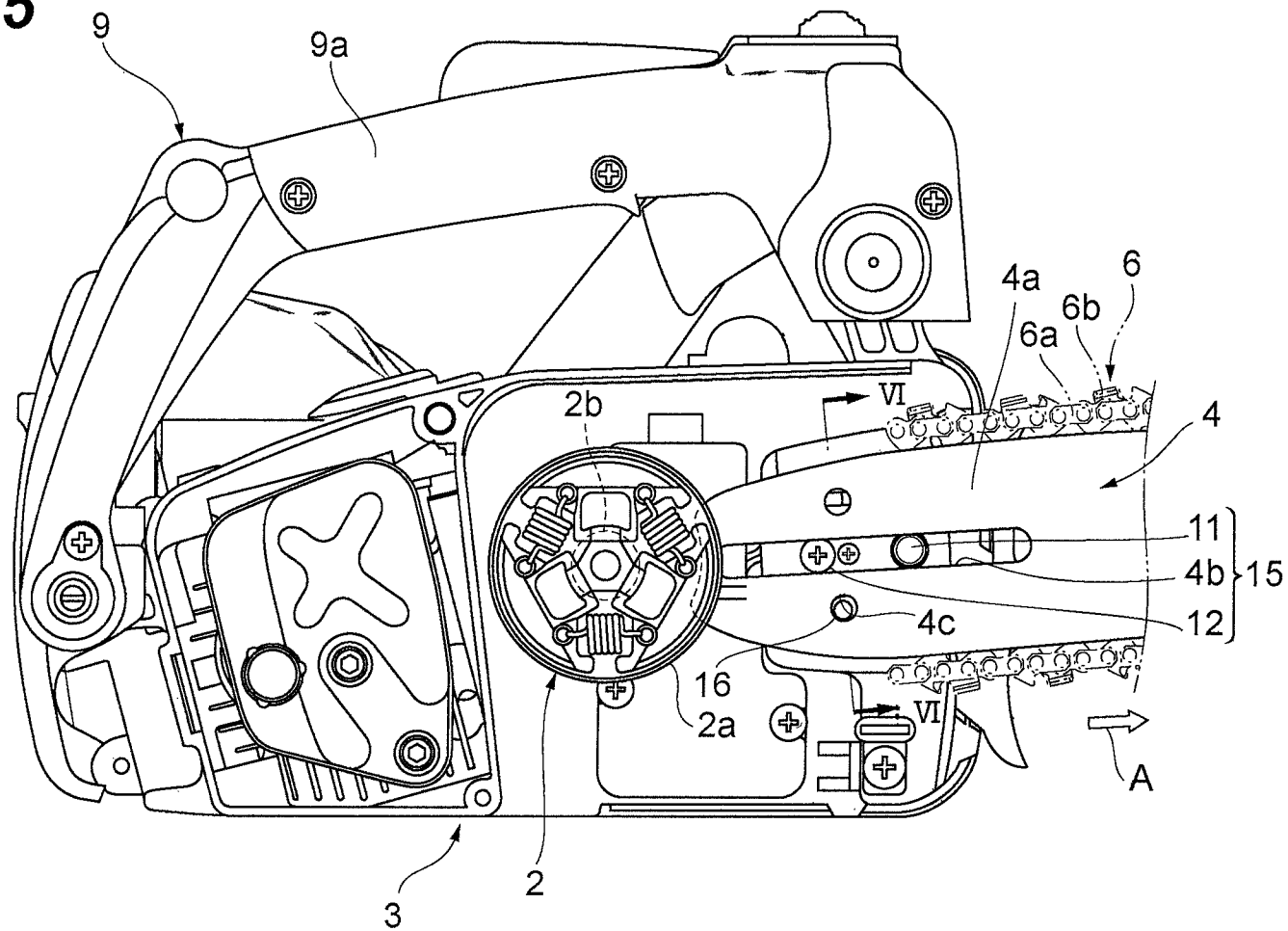
FIG. 5 illustrates a state in which the guiding bar is prefixed to the chain saw main body in FIG. 3.

FIG. 5 illustrates a state of the guiding bar 4 that is prefixed to the chain saw main body 3 in FIG. 3. As illustrated in FIG. 5, the guiding bar 4 is provided with a long hole 4*b*, having a predetermined vertical width, that extends through the guiding bar 4 in the thickness direction and extends in the extending direction A of the guiding bar 4 and a circular hole 4*c* extends through the guiding bar 4 below the long hole 4*b* in the thickness direction. The long hole 4*b* and the circular hole 4*c* are provided at positions corresponding to the bolts 11 and 12 and the cap 16, respectively. In the prefixed state of the guiding bar 4 illustrated in FIG. 5, the bolts 11 and 12 are inserted into the long hole 4*b*, and the cap 16 is inserted into the circular hole 4*c*.

With such a structure, when the guiding bar 4 is prefixed and the cap 16 protrudes from the main body 3, the guiding bar 4 is supported at three points (apparently two points when viewed from the vertical direction) by the cap 16 and the bolts 11 and 12. This structure prevents the guiding bar 4 from tilting forward and/or being detached from the guiding plate 10, and thus, the orientation of the prefixed guiding bar 4 can be stabilized. When the cap 16 is pushed into the main body 3, the guiding bar 4 is guided by the bolts 11 and 12 and the long hole 4*b* and slides on the guiding plate 10 in the extending direction A.

As described above, the guiding-bar attaching bolt 11, the bolt 12, and the long hole 4*b* constitutes a guiding unit 15 that guides the guiding bar 4 in the extending direction A.

Figure 6:
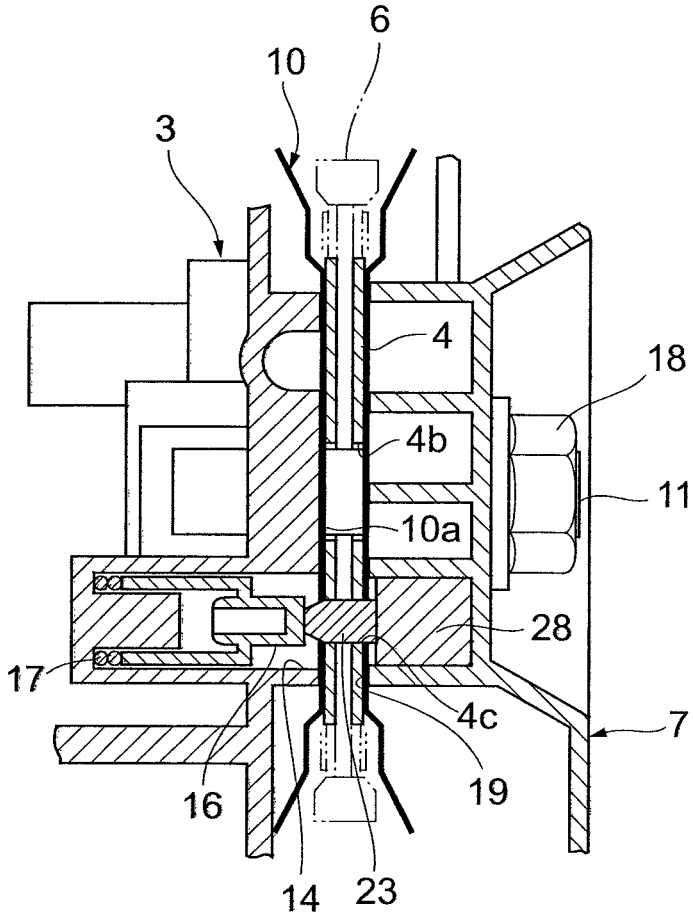
FIG. 6 is a sectional view taken along line VI-VI in FIG. 5 and illustrates a state in which a chain case is attached to the main body.

As illustrated in FIG. 6, the chain case 7 is attached to the chain saw main body 3 and fixed with the guiding-bar attaching bolt 11 and a nut 18, so that the guiding bar 4 is clamped by the guiding plate 10 and the chain case 7. In order to adjust the tension of the saw chain 6, the nut 18 is loosed and then the guiding bar 4 is moved in the extending direction A while the orientation of the guiding bar 4 is maintained.

Figure 7:
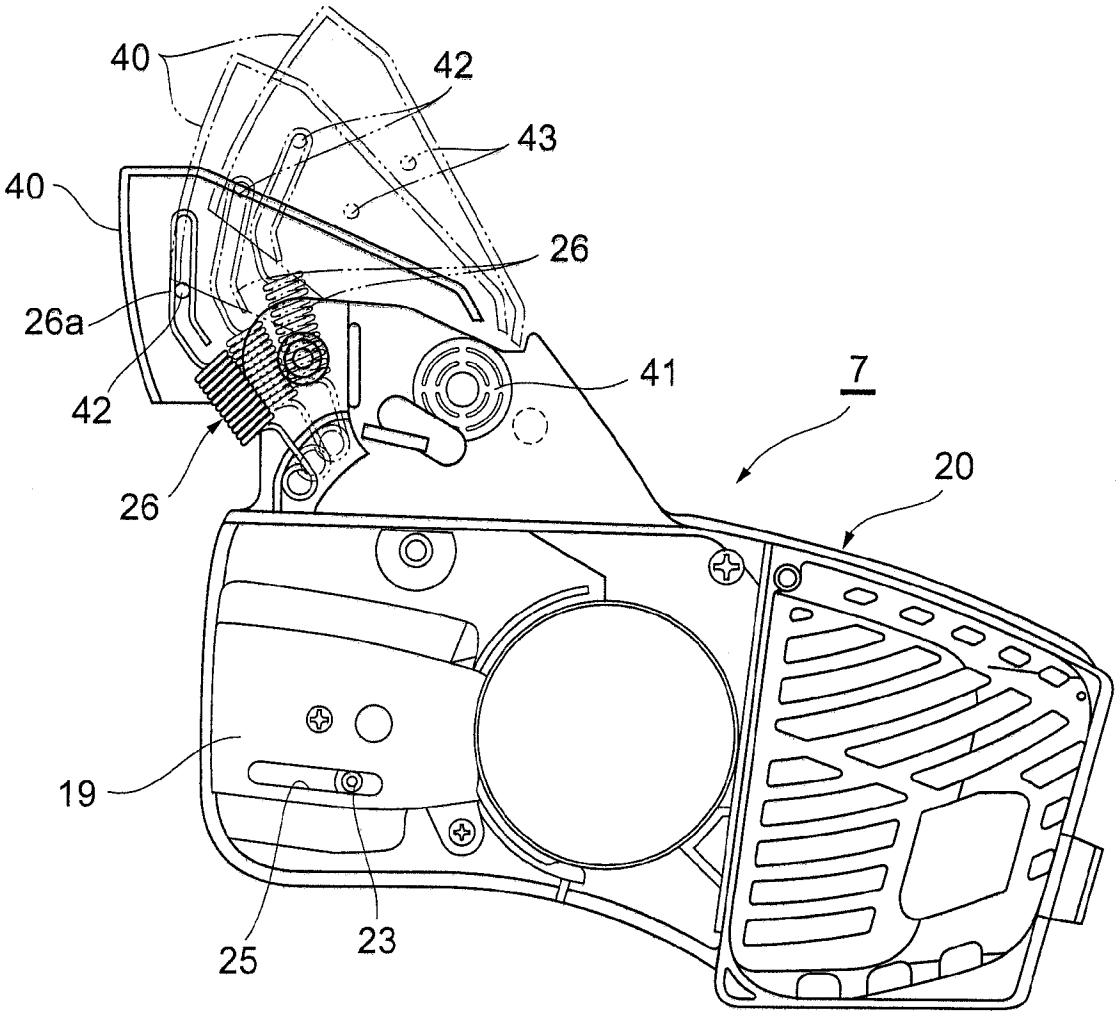
FIG. 7 illustrates the chain case viewed from the inside.
Figure 8:
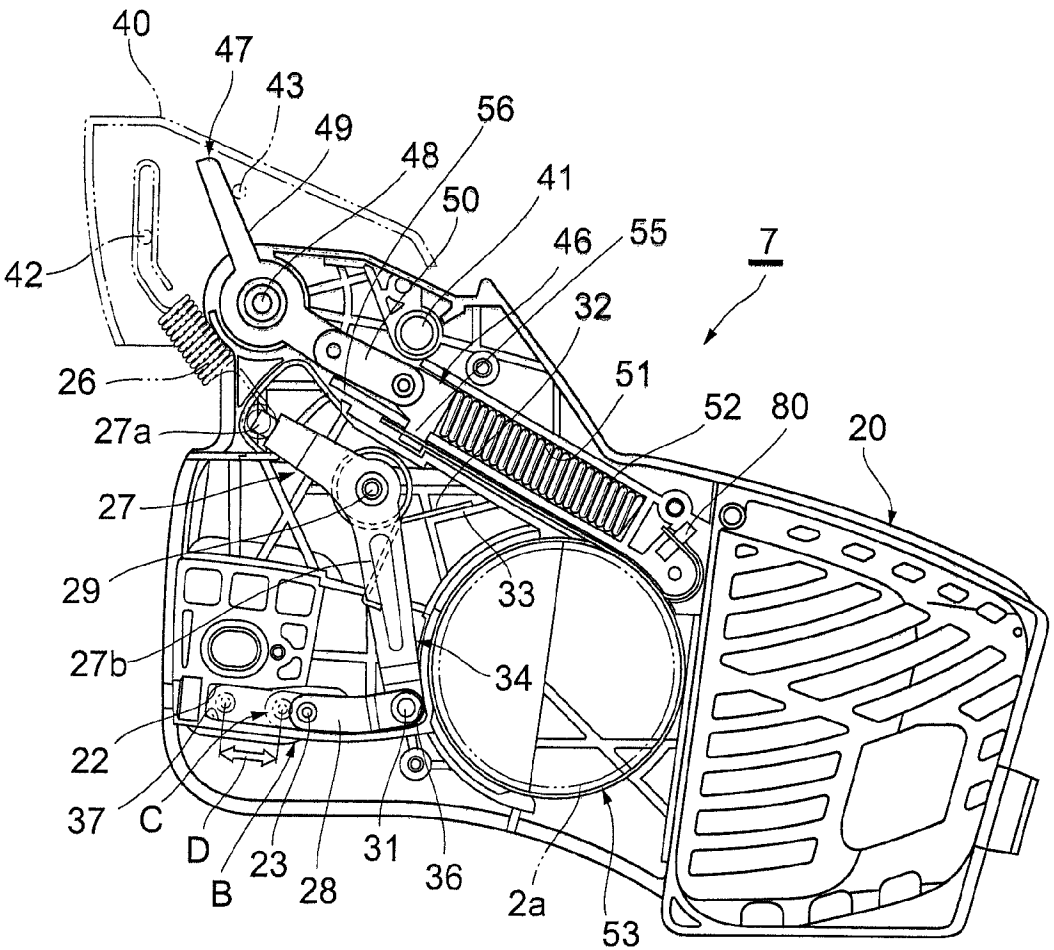
FIG. 8 illustrates a chain brake in the chain case in FIG. 7 in an inactivated state.
Figure 9:
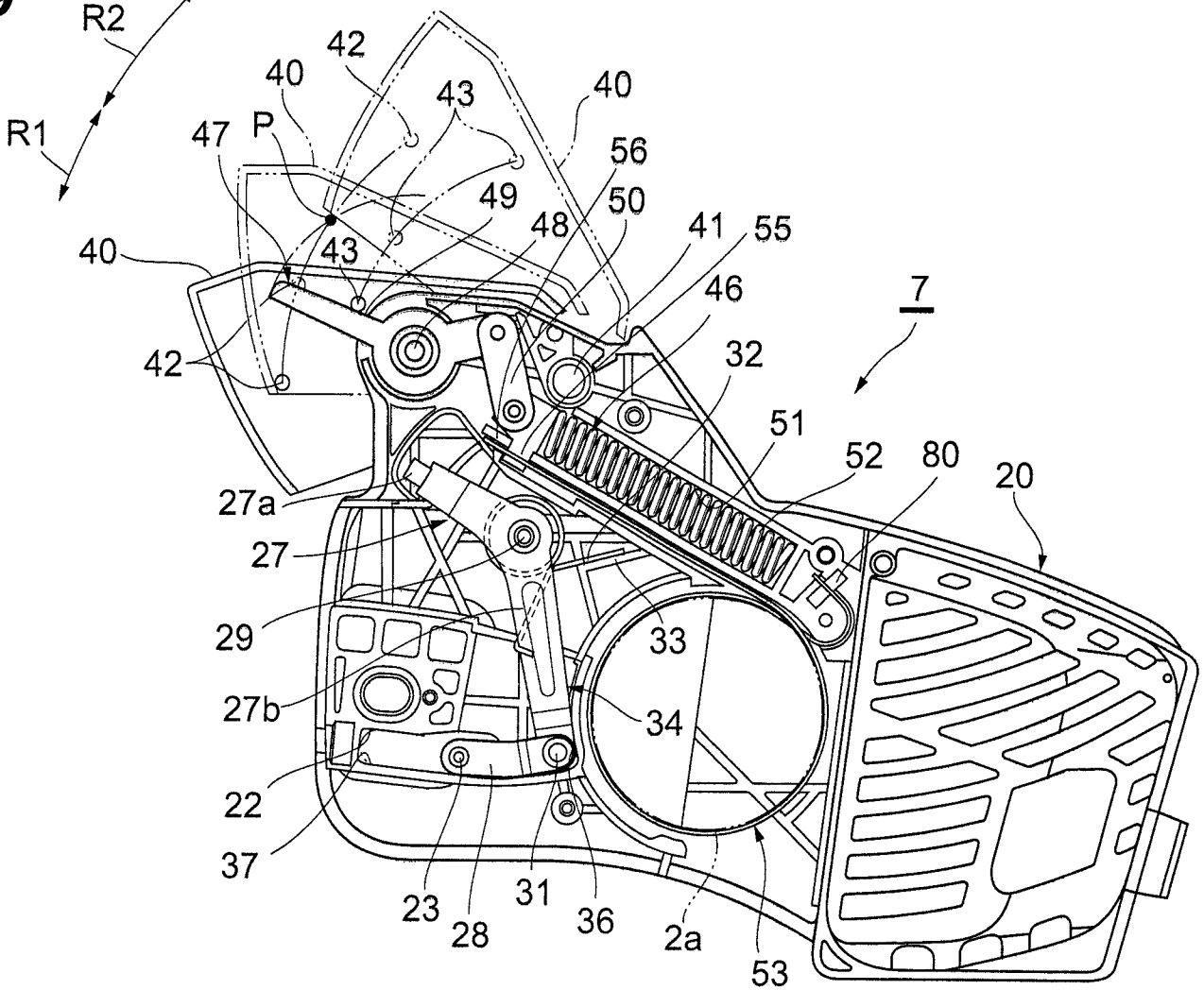
FIG. 9 illustrates the chain brake in the chain case in FIG. 7 in an activated state.

FIG. 7 illustrates the chain case 7 in FIG. 1 viewed from the inside. FIG. 8 illustrates a chain brake in the chain case in FIG. 7 in an inactivated state. FIG. 9 illustrates the chain brake in the chain case in FIG. 7 in an activated state.

As illustrated in FIGS. 7 to 9, the chain case 7 includes a case body 20 that is attached to the right side of the main body 3. The chain case 7 includes a turnable hand guard 40 for protecting the operator's hands that is pivoted to the upper part of the case body 20 at a pivotal support 41 (also see FIGS. 1 and 2).

The chain case 7 includes a chain brake 46 that is a braking mechanism to stop the rotation of the rotating unit 2 during the operation of the chain saw 1 and a chain tension unit 21 (see FIG. 10) that is a tension adjusting mechanism to adjust the tension of the saw chain 6.

The hand guard 40 allows an operator to operate the chain brake 46 and functions as an operation lever, which is part of the chain tension unit 21. The hand guard 40 turns within a predetermined range around the pivotal support 41. Specifically, the chain brake 46 can be operated by turning the hand guard 40 within a lower turnable range (first range) R1 (see FIG. 9). The chain tension unit 21 can be operated by turning the hand guard 40 within an upper turnable range (second range) R2, which is different from the turnable range R1.

The hand guard 40 also includes first rod pin 42 and second rod pin 43 that are provided on the inner side of the hand guard 40 and protrude in the width direction of the chain saw 1 by a predetermined length.

In the normally used state of the chain saw 1, as represented by a solid line in FIG. 7, the first rod pin 42 is disposed closer to the front of the hand guard 40. The second rod pin 43 is disposed backward and slightly upward to the first rod pin 42 (see FIG. 8). The first rod pin 42 releases the brake of the chain brake 46 and applies tension to the saw chain 6. The second rod pin 43 activates the chain brake 46. The chain brake 46 and the chain tension unit 21 will be described below.

First, the chain brake 46 will be described. As illustrated in FIG. 8, the chain brake 46 includes a brake lever (pivotal lever) 47 that turns around a shaft 48 due to a biasing force from the second rod pin 43 or the first rod pin 42 to activate or release the brake; a link 50 of which one end is connected to the base of the brake lever 47; a brake spring 52 that is a compression spring urging the other end of the link 50 and disposed inside a cylindrical spring container 51; and a ring band brake 53 that brakes the rotating unit 2 (see FIG. 5) in response to expansion of the brake spring 52.

The brake lever 47 is disposed such that a pin contacting part 49 extending upward from the shaft 48 is positioned between the first rod pin 42 and the second rod pin 43 within the turnable range R1 of the hand guard 40 (see FIG. 9). Lowering the hand guard 40 causes the second rod pin 43 to slide on the pin contacting part 49 to lower the pin contacting part 49. As a result, the brake is activated. In contrast, raising the hand guard 40 causes the first rod pin 42 to slidably raise the pin contacting part 49. As a result, the brake is released.

The shaft 48, which is a turning center of the pin contacting part 49, is disposed at a position different from the position of the pivotal support 41, which is a turning center of the first rod pin 42. Due to such a difference in the position between the pivotal support 41 and the shaft 48, the pivot locus of the first rod pin 42 intersect the pivot locus of the tip of the pin contacting part 49 at a position near the brake-releasing position of the brake lever 47 (see position P in FIG. 9). Therefore, by raising the hand guard 40, the brake lever 47 is raised by the first rod pin 42 positioned below the tip of the pin contacting part 49 and then is detached from the first rod pin 42 at position P. In other words, the hand guard 40 is in contact with the brake lever 47 within the turnable range R1 but is detached from the brake lever 47 within the turnable range R2 in which the first rod pin 42 is positioned above the detaching position P.

The ring band brake 53 is detachably wound around the circumference of the clutch drum 2*a* of the rotating unit 2 (see FIG. 5). One end of the ring band brake 53 is connected to a latch 55 provided at an upper end of the brake spring 52. The other end of the ring band brake 53 is fixed to a latch 80 provided on the case body 20. At an inactivated state of the brake, as illustrated in FIG. 8, the ring band brake 53 is detached from the clutch drum 2*a* and allows rotation of the rotating unit 2 to rotate. At an activated state of the brake, as illustrated in FIG. 9, the ring band brake 53 tightens the clutch drum 2*a* as the brake spring 52 expands.

The brake spring 52 holds its position (orientation) by the urging force of the brake spring 52 and by contact of the link 50 to a wall 56 while the brake is not activated. Accordingly, to activate or release the brake of the chain brake 46 by lowering or raising the hand guard 40, the hand guard 40 should be operated with a force greater than the force holding the brake spring 52 in position. When kickback, which is bouncing of the chain saw 1 during operation, occurs, the hand guard 40 is strongly pushed down by the left hand, so that the chain brake 46 executes an emergency stop of the chain saw 1.

Figure 10:
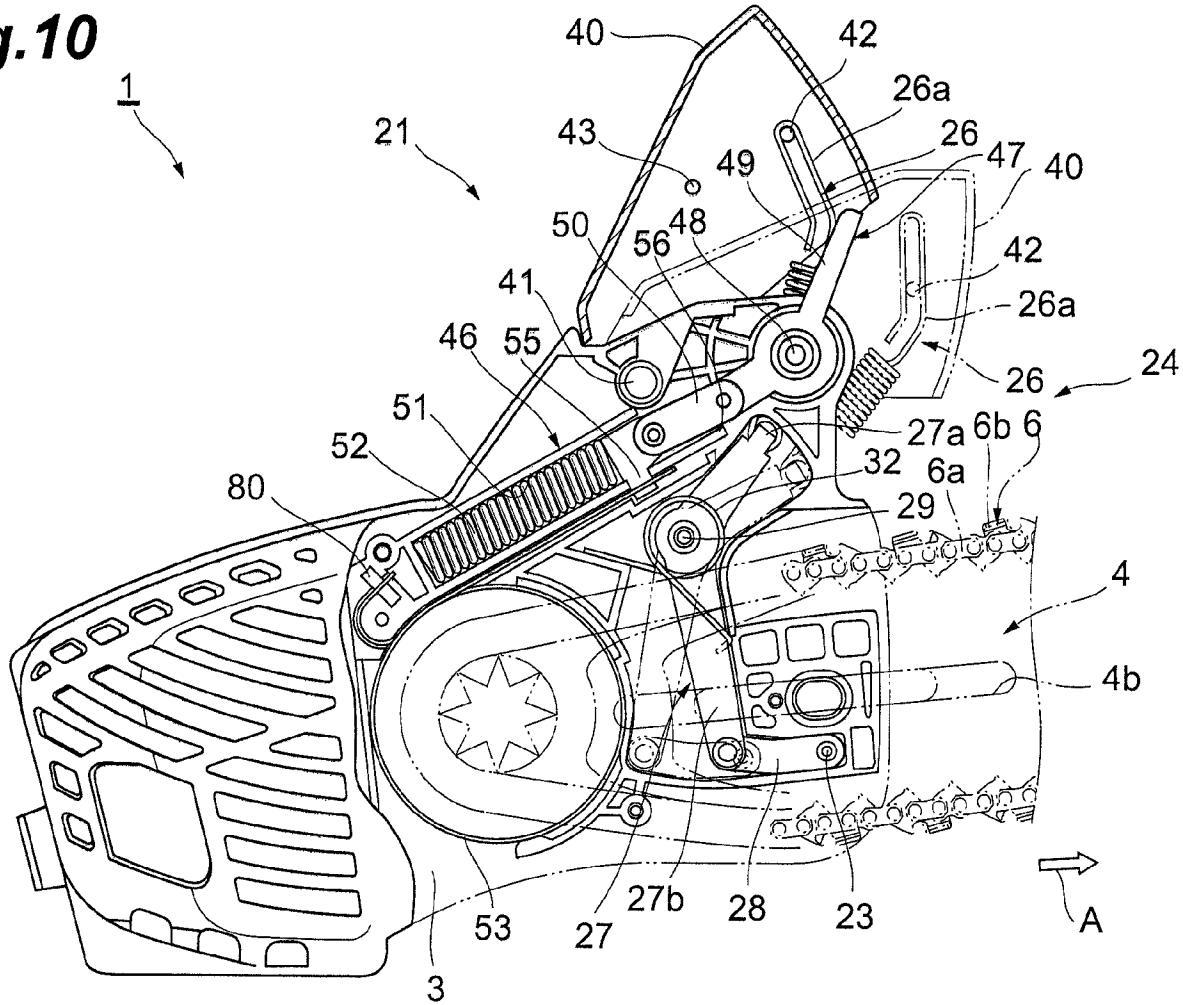
FIG. 10 is a schematic diagram illustrating tension adjustment of the saw chain by a chain tension unit.

Next, the chain tension unit 21 will be described with reference to FIG. 10. FIG. 10 is a schematic diagram illustrating tension adjustment of the saw chain 6 by the chain tension unit 21 of the chain saw 1. As illustrated in FIG. 10, the chain tension unit 21 includes the hand guard 40, which is an operating lever operated by an operator; a boss 23 for adjusting the tension of the saw chain, the boss 23 protruding from an opening 25 (see FIG. 7) of an inner cover 19 (see FIGS. 6 and 7) provided in the inner side of the chain case 7 to the main body 3 and extending through the hole 4*c* (see FIG. 5) of the guiding bar 4; and a connecting unit 24 that connects the boss 23 to the hand guard 40. The hand guard 40, the boss 23, and the connecting unit 24 are integrated in the chain case 7.

The boss 23 protrudes from the inner cover 19 of the chain case 7 by a predetermined length. The protruding length of the boss 23 is greater than the thickness of the guiding bar 4, as illustrated in FIG. 6. The boss 23 extends through the hole 4*c* of the guiding bar 4 while the chain case 7 is attached to the main body 3 and reaches the groove 14 in which the cap 16 is disposed.

The connecting unit 24 includes a connecting spring (spring) 26 of which the upper end is connected to the first rod pin 42 of the hand guard 40, the spring 26 being an extension coil spring having a predetermined spring constant; a first link 27 of which a first end is connected to the lower end of the connecting spring 26, the first link 27 being pivoted at a shaft 29; and a second link 28 is pivotally connected to a second end of the first link 27 with a connecting shaft 31, the front end of the second link 28 having the boss 23.

The connecting spring 26 is a connecting member that is pulled through operation of the hand guard 40 to rotate the first link 27 clockwise in FIGS. 8 and 9. This rotation causes the second link 28 and the boss 23 to move forward. The upper end (first end) of the connecting spring 26 has a U-shaped segment 26*a* that is bent further backward than the axis of the coil spring (see FIGS. 7 and 10). The U-shaped segment 26*a* consists of a linear portion extending from the coil spring and a bent portion bent into a U shape. The end of the bent portion extends to a position at a predetermined distance from the upper end of the coil spring. The first rod pin 42 is freely fit into the U-shaped segment 26*a* such that the first rod pin 42 reciprocates in the longitudinal direction.

In the normally used state of the chain saw 1, as represented by the solid line in FIG. 7, the first rod pin 42 of the hand guard 40 is resides in the middle of the U-shaped segment 26*a* in the longitudinal direction. As represented by the two-dot chain lines, in response to the rise of the hand guard 40, the first rod pin 42 moves upward in the U-shaped segment 26*a* to engage the inner upper end of the U-shaped segment 26*a* in the longitudinal direction. As a result of the engagement, the connecting spring 26 is pulled upward by the first rod pin 42. The hand guard 40 is connected to the connecting spring 26 by the first rod pin 42.

The position where the first rod pin 42 engages the inner upper end of the U-shaped segment 26*a* is substantially the same as the detaching position P where the brake lever 47 is detached from the first rod pin 42 (the intersection of the pivot locus of the first rod pin 42 and the pivot locus of the tip of the pin contacting part 49 (see FIG. 9)). Specifically, in the turnable range R2 in which the first rod pin 42 is detached from the brake lever 47, the hand guard 40 can pull up the connecting spring 26 due to engagement of the first rod pin 42 and the U-shaped segment 26*a*. As a result, in the turnable range R2, the hand guard 40 is connected to the connecting unit 24. The saw chain 6 is thereby strained (the hand guard 40 is moved from the position represented by the solid lines in FIG. 10 to the position represented by the two-dot chain line) without interference with the brake lever 47 by the first rod pin 42.

The upper end 27*a* of the first link 27 included in the connecting unit 24 is pivoted to the lower end of the connecting spring 26. The first link 27 bends at the position of the shaft 29 and extends toward upper right. The first link 27 turns counterclockwise in FIG. 10 in response to tension from the connecting spring 26 and pushes the second link 28 and the boss 23 forward (in the direction A in FIG. 10).

With reference to FIGS. 8 and 9, the second link 28 can move in the anteroposterior direction inside a guiding part 22 that is formed in the inner side of the case body 20 and has a groove-like cross-section perpendicular to the longitudinal direction. A rear wall 36 and a front wall 37 that restrict the movement of the second link 28 are provided at the rear and front ends, respectively, of the guiding part 22.

A torsion spring 32 that moves the boss 23 to an initial position B represented by solid lines in FIG. 8 is attached to the first link 27. Specifically, a first end of the torsion spring 32 is locked to a locking part 33 provided on the inside of the case body 20. The torsion spring 32 is wound around the shaft 29 at least once. A second end of the torsion spring 32 is hooked to a lower part 27*b* of the first link 27 from the front side.

In the chain tension unit 21 having such a structure, the torsion spring 32 urges the lower part 27*b* of the first link 27 backward such that the lower part 27*b* comes into contact with the rear wall 36 while the boss 23 is set at the initial position B. The initial position B faces the cap 16 provided on the main body 3 when the chain case 7 is attached to the main body 3 (see FIGS. 3 and 5). The first link 27, the second link 28, the guiding part 22, the torsion spring 32, and the rear wall 36 constitute a moving unit 34 that moves the boss 23 to the initial position B.

The boss 23 is connected to the hand guard 40 and moves in response to the movement of the hand guard 40 against a backward urging force of the moving unit 34 in a predetermined adjustment range D from the rearmost position C, which is at a minimum forward distance for straining the saw chain 6, to a front position right behind the front wall 37 (see FIG. 8).

In the chain saw 1 having such a structure, to prefix the guiding bar 4 to the main body 3, the bolts 11 and 12 and the cap 16 attached to the main body 3 are passed through the long hole 4*b* and the hole 4*c*, respectively. Since the positions of the bolts 11 and 12 and the cap 16 correspond to the long hole 4*b* and the hole 4*c*, respectively, the guiding bar 4 can easily be prefixed without precise alignment.

By attaching the chain case 7 to the main body 3 as illustrated in FIG. 1, the boss 23 moved to the initial position B by the moving unit 34 moves into the hole 4*c* in the guiding bar 4 and the groove 14 in the main body 3 to push the cap 16 into the main body 3 (see FIG. 6).

While the cap 16 is retracted (removed) from the hole 4*c* in the guiding bar 4 as a result of being pushed into the main body 3, the tension of the saw chain 6 can be adjusted as the guiding bar 4 is guided in the extending direction A by the guiding unit 15 (bolts 11 and 12 and long hole 4*b*).

Specifically, in response to the turning operation of the hand guard 40 upward within the turnable range R2 (see FIG. 9), the connecting spring 26 is pulled and expand to pivot the first link 27. The turn of the first link 27 causes the boss 23 in the hole 4*c* in the guiding bar 4 to move through the groove 14 in the extending direction A. The movement of the boss 23 causes the guiding bar 4 to move in the extending direction A to strain the saw chain 6 (see the solid lines in FIG. 10).

The tension of the saw chain 6 is adjusted to a desired value by turning the hand guard 40 upward to a predetermined position as a result of the balance between the spring constant of the connecting spring 26 and the tension resistance of the saw chain 6. For example, at a large tension resistance of the saw chain 6, turning the hand guard 40 further upward from the predetermined position only causes the connecting spring 26 to expand, and the first link 27, the second link 28, and the boss 23 to hardly move. Thus, the tension of the saw chain 6 is maintained substantially constant regardless of the user operating the hand guard 40. After straining the saw chain 6, the nut 18 is tightened to clamp the guiding bar 4.

During operation of the chain saw 1, if the hand guard 40 is strongly pushed down (turned downward) by the operator's left hand, for example, in response to kickback, the second rod pin 43 pushes down the brake lever 47 of the chain brake 46 to activate the chain brake 46. The activated state is represented by solid lines in FIG. 9.

After the brake is activated, the brake can be released by turning the hand guard 40 upward such that the first rod pin 42 pushes the brake lever 47 upward. This released state is illustrated in FIG. 8.

In the chain saw 1 of the embodiment described above, the tension of the saw chain 6, which is attached around the outer edge of the guiding bar 4, can be adjusted appropriately by adjusting the force transmitted to the connecting unit 24 during operation of the hand guard 40. Thus, the saw chain 6 can be easily strained at great tension without use of a strong coil spring.

Since the connecting unit 24 includes the connecting spring 26 connected to the hand guard 40, the force transmitted to the connecting unit 24 can be buffered by the elasticity of the connecting spring 26. As a result, the tension of the saw chain 6 can be maintained substantially constant.

Since the hand guard 40, which protects the operator's hand, is also used to adjust tension, a separate lever for tension adjustment of the saw chain 6 is not required.

When the hand guard 40 turns around the pivotal support 41 within the turnable range R1, it comes into contact with the brake lever 47, which turns around the shaft 48. As a result, the chain brake 46 can be operated. When the hand guard 40 turns within the turnable range R2, which is different from the turnable range R1, it is detached from the brake lever 47 due to the difference in the positions of the pivotal support 41 and the shaft 48 and is connected to the connecting unit 24. As a result, within the turnable range R1, the chain brake 46 can be activated without interference. Tension adjustment of the saw chain 6 can be achieved without interference by the movement of the guiding bar 4 in response to the turning of the hand guard 40 within the turnable range R2. Brake activation and tension adjustment of the saw chain 6 can be performed independently.

The first rod pin 42 of the hand guard 40 is freely fit into the U-shaped segment 26*a* of the connecting spring 26 or a U-shaped segment 60*a* of a connecting member 60 (the U-shaped segment 60*a* of the connecting member 60 is described below). Thus, in a normally used state other than tension adjustment of the saw chain 6, the first rod pin 42 can be unfixed in the U-shaped segment 26*a* or 60*a*. As a result, connection by the connecting unit 24 is not maintained, and cutting by the chain saw 1 can be performed without interference.

Since the boss 23, the hand guard 40, and the connecting unit 24 are integrated in the chain case 7, assembly of these components associated with tension adjustment of the saw chain 6 is easy.

Since the tension of the saw chain 6 is set by the resilience (spring constant) of the connecting spring 26, every operator can adjust the tension with similar precision. Uniform tension of the saw chain 6 improves safety and can avoid overstraining of the saw chain 6, which extends the life of the guiding bar 4 and the saw chain 6. Furthermore, this prevents damage of the guiding bar 4 and detachment of the saw chain 6 due to a lack of tension in the saw chain 6.

The chain tension unit 21 can adjust the tension of the saw chain 6 readily and definitely. This allows the downtime of the chain saw 1 to be minimized during the frequent adjustment of the tension required for a new saw chain 6, which undergoes initial extension.

Since the chain tension unit 21 is configured without precision components and gears but with merely general-purpose components, such as springs, production costs can be reduced.

Second Embodiment

Figure 11:
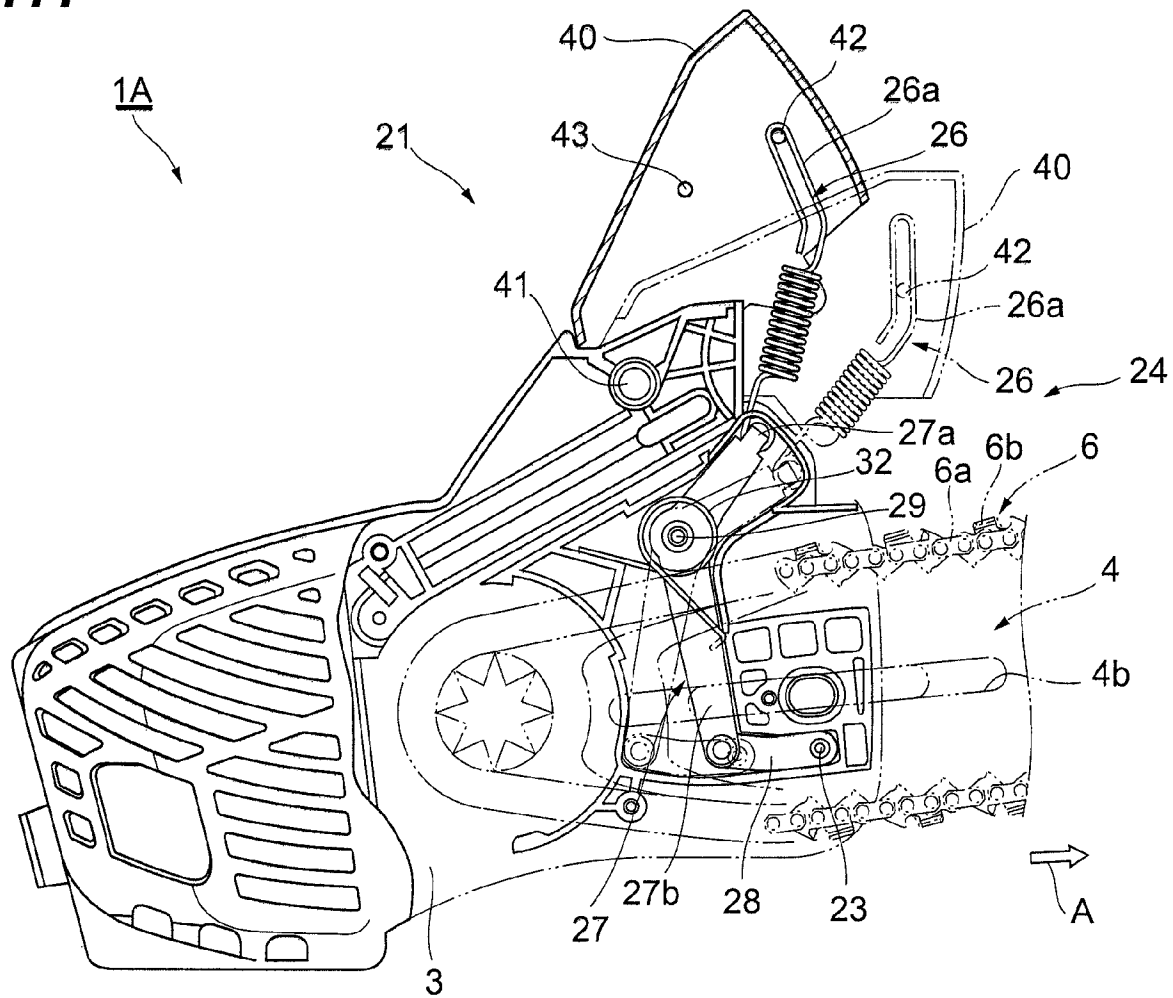
FIG. 11 is a schematic diagram illustrating tension adjustment of a saw chain by a chain tension unit of a chain saw according to a second embodiment.

FIG. 11 illustrates the operation of a chain tension unit of a chain saw according to a second embodiment during tension adjustment. The chain saw 1A according to this embodiment illustrated in FIG. 11 differs from the chain saw 1 according to the first embodiment illustrated in FIG. 10 in that it does not include the chain brake 46. In the chain saw 1A, the chain tension unit 21 adjusts the tension of the saw chain 6 in a manner similar to that in the chain saw 1. In this case, the operation and advantages are the same as those of the chain saw 1.

Third Embodiment

Figure 12:
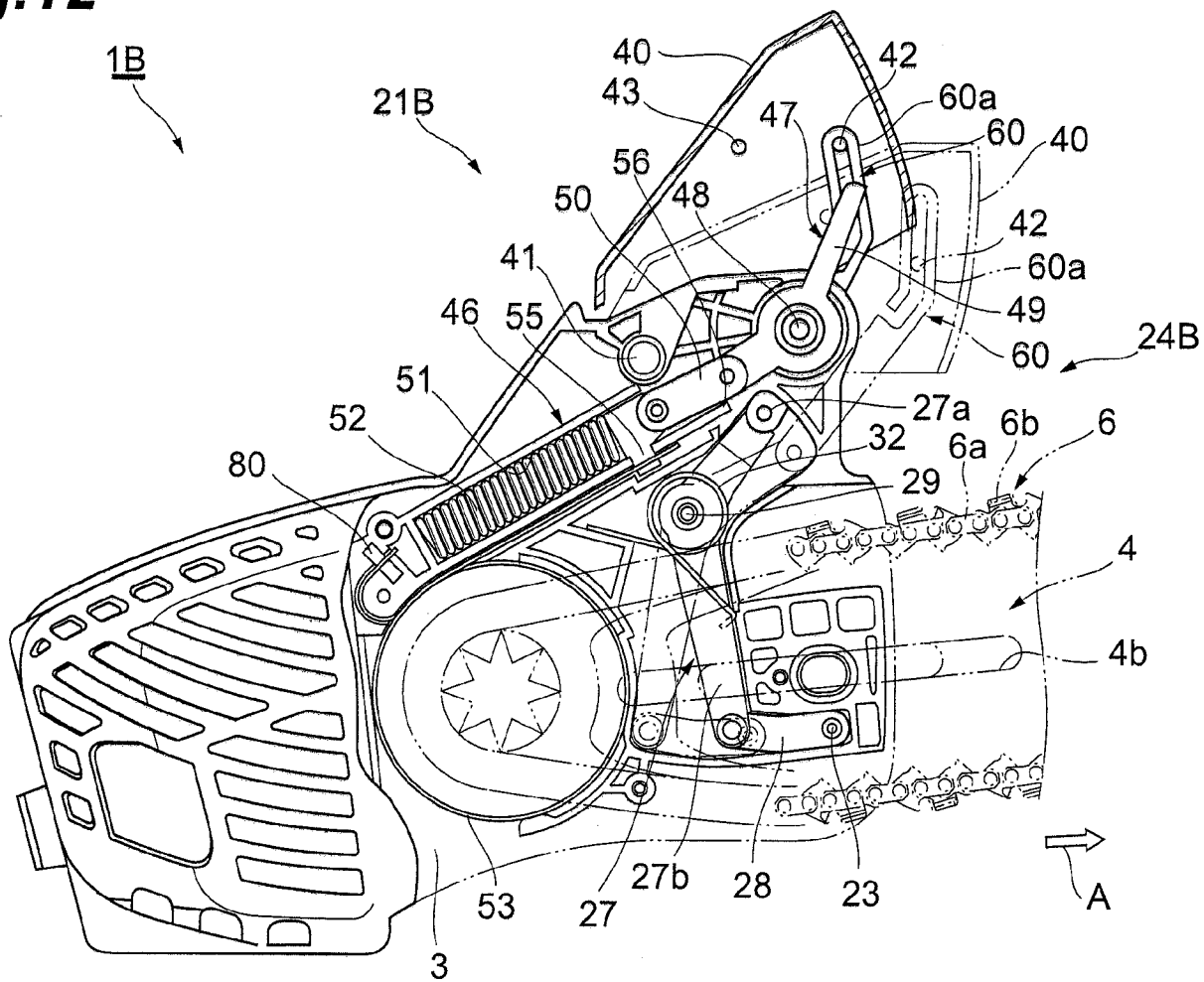
FIG. 12 is a schematic diagram illustrating tension adjustment of a saw chain by a chain tension unit of a chain saw according to a third embodiment.

FIG. 12 illustrates the operation of a chain tension unit of a chain saw during tension adjustment according to a third embodiment. The chain saw 1B according to this embodiment illustrated in FIG. 12 differs from the chain saw 1 according to the first embodiment illustrated in FIG. 10 in that a resin connecting member 60 is included instead of the connecting spring 26. In association with this change, the connecting unit 24 and the chain tension unit 21 are replaced with a connecting unit 24B and a chain tension unit 21B, respectively.

The connecting member 60 has a U-shaped segment 60*a* that has a similar shape as the U-shaped segment 26*a* of the connecting spring 26. The first rod pin 42 of the hand guard 40 is freely fit into the U-shaped segment 60*a*. The other structures of the chain tension unit 21B are the same as those of the chain tension unit 21 of the chain saw 1.

In the chain saw 1B, the chain tension unit 21B can adjust the tension of the saw chain 6 in a manner similar to that in the chain saw 1. The connecting member 60 of the chain tension unit 21B can adjust the tension of the saw chain 6 in accordance with the pulling force (turning height) of the hand guard 40.

Fourth Embodiment

Figure 13:
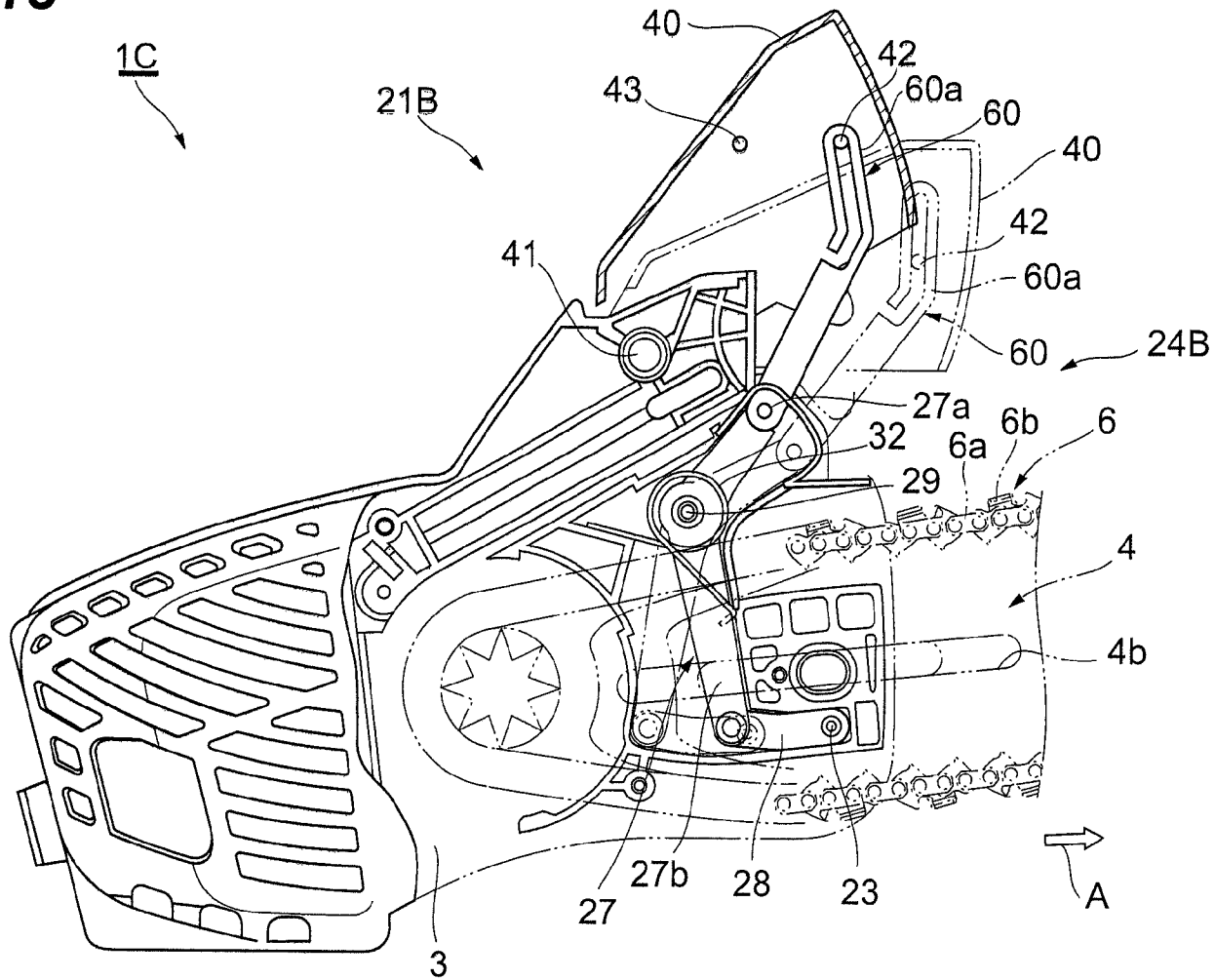
FIG. 13 is a schematic diagram illustrating tension adjustment of a saw chain by a chain tension unit of a chain saw according to a fourth embodiment.

FIG. 13 illustrates the operation of a chain tension unit of a chain saw during tension adjustment according to a fourth embodiment. The chain saw 1C according to this embodiment illustrated in FIG. 13 differs from the chain saw 1B according to the third embodiment illustrated in FIG. 12 in that the chain brake 46 is not included. In the chain saw 1C, the chain tension unit 21B can adjust the tension of the saw chain 6 in a manner similar to that in the chain saw 1B.

The present invention are not limited to the embodiments described above. For example, in the embodiments described above, the chain tension unit 21 is integrated in the chain case 7. Instead, the chain tension unit 21 may be provided on the main body 3. Furthermore, the connecting unit 24 may include only a link mechanism, instead of the connecting spring 26 and the connecting member 60.

What is claimed is:

1. A chain saw comprising:

a main body having a rotating unit transmitting a driving force;

a guiding bar attached to the main body and extending from the front of the main body;

an endless saw chain attached around the outer edges of the rotating unit and guiding bar;

a guiding unit guiding the guiding bar in an extending direction of the guiding bar;

a hole provided in the guiding bar and extending in the thickness direction of the guiding bar;

a locking protrusion disposed in the hole;

a connecting unit connecting the locking protrusion and an operating lever operated by an operator; and a braking mechanism stopping the rotation of the rotating unit, wherein the guiding bar and the locking protrusion disposed in the hole of the guiding bar move in the extending direction being a straining direction of the saw chain, such that tension of the saw chain is adjusted in response to an operation of the operating lever, wherein, when the operating lever turns around a pivotal support within a first range, the operating lever comes into contact with a pivotal lever of the braking mechanism turning around a shaft residing at a position different from the pivotal support, to operate the braking mechanism, and wherein, when the operating lever turns around the pivotal support within a second range differing from the first range, the operating lever is configured to be detached from the pivotal lever at a position due to the difference in the positions of the pivotal support and the shaft and to be connected to the connecting unit.

2. The chain saw according to claim 1, wherein the connecting unit comprises a spring connected to the operating lever.

3. The chain saw according to claim 1, wherein the operating lever comprises a hand guard protecting a hand of an operator.

4. The chain saw according to claim 1, wherein, a first end of the connecting unit has a connecting member including a U-shaped segment, the operating lever includes a pin, and the pin is freely fit into the U-shaped segment.

5. The chain saw according to claim 1, further comprising:

a chain case attached to the main body to cover a base of the guiding bar, wherein the locking protrusion, the operating lever, and the connecting unit are integrated in the chain case.

* * * * *